US011208259B2

(12) United States Patent
Chartrel et al.

(10) Patent No.: US 11,208,259 B2
(45) Date of Patent: Dec. 28, 2021

(54) FLEXIBLE STORAGE DEVICE FOR PACKAGING PARTICULATE SOLID SUBSTANCES OR LIQUIDS, METHOD FOR MANUFACTURING THIS DEVICE AND PACKAGING METHOD USING THIS DEVICE

(71) Applicants: ROQUETTE FRERES, Lestrem (FR); SO BAG, Blanzy (FR)

(72) Inventors: Bernard Chartrel, Lestrem (FR); Nicolas Chevalier, Le Breuil (FR)

(73) Assignees: ROQUETTE FRERES, Lestrem (FR); SO BAG, Blanzy (FR)

( * ) Notice: Subject to any disclaimer, the term of this patent is extended or adjusted under 35 U.S.C. 154(b) by 405 days.

(21) Appl. No.: 15/744,235

(22) PCT Filed: Jul. 22, 2016

(86) PCT No.: PCT/FR2016/051915
§ 371 (c)(1),
(2) Date: Jan. 12, 2018

(87) PCT Pub. No.: WO2017/017361
PCT Pub. Date: Feb. 2, 2017

(65) Prior Publication Data

US 2018/0194549 A1 Jul. 12, 2018

(30) Foreign Application Priority Data

Jul. 24, 2015 (FR) ..... 15 57060

(51) Int. Cl.
*B65D 88/16* (2006.01)

(52) U.S. Cl.
CPC ..... *B65D 88/1618* (2013.01); *B65D 88/165* (2013.01); *B65D 88/1631* (2013.01);
(Continued)

(58) Field of Classification Search
CPC ..... B65D 88/16; B65D 88/1606; B65D 88/1612; B65D 88/1618; B65D 88/1625;
(Continued)

(56) References Cited

U.S. PATENT DOCUMENTS 3,282,621 A * 11/1966 Peterson ..... B65D 33/14 294/68.3
4,207,937 A * 6/1980 Sandeman ..... B65D 88/1612 383/117

(Continued)

FOREIGN PATENT DOCUMENTS

DE 196 17 902 C1 7/1997
EP 0 664 258 A1 7/1995

(Continued)

OTHER PUBLICATIONS

International Search Report, dated Feb. 2, 2017, from corresponding PCT application No. PCT/FR2016/051915.

*Primary Examiner* — Jes F Pascua
*Assistant Examiner* — Nina K Attel
(74) *Attorney, Agent, or Firm* — Nixon & Vanderhye

(57) ABSTRACT

A flexible storage device for packaging particulate solid substances or liquids, having a bottom and lateral walls defining a storage volume, includes: hanging loops toward the top intended for lifting an assembly including: a flexible external wrapper forming at least the four lateral walls of the storage volume, a flexible tubular internal wrapper secured to the four lateral walls of the external wrapper, dividing the storage volume into five vertical compartments including a central compartment defined by the interior volume of the internal wrapper, and four peripheral compartments defined between the lateral walls of the external wrapper and the lateral walls of the internal wrapper. The internal wrapper has an upper edge defining the upper mouth of the central compartment and a lower edge defining the lower mouth of (Continued)

the central compartment. The upper edge of the internal wrapper is at or below the upper edge of the lateral walls.

16 Claims, 7 Drawing Sheets

(52) U.S. Cl.
CPC ..... *B65D 88/1643* (2013.01); *B65D 88/1656* (2013.01); *B65D 88/1668* (2013.01); *B65D 88/1681* (2013.01)

(58) Field of Classification Search
CPC ..... B65D 88/1631; B65D 88/1637; B65D 88/1643; B65D 88/165; B65D 88/1656; B65D 88/1662; B65D 88/1668; B65D 88/1675; B65D 88/1681; B65D 88/1687; B65D 88/1693; B65D 88/18; B65D 88/20; B65D 88/22; B65D 88/24
USPC ..... 383/6
See application file for complete search history.

(56) References Cited

U.S. PATENT DOCUMENTS

| | | | | |
|---|---|---|---|---|
| 5,649,767 | A * | 7/1997 | Nickell | B65D 88/1618 383/105 |
| 6,305,845 | B1 * | 10/2001 | Navin | B65D 88/1618 383/109 |
| 6,331,334 | B1 | 12/2001 | Trepte et al. | |
| 8,590,725 | B2 | 11/2013 | Chartrel et al. | |
| 2004/0076791 | A1 * | 4/2004 | Akdogan | B65D 88/165 428/90 |
| 2012/0055932 | A1 * | 3/2012 | Chartrel | B65D 88/1631 220/495.01 |
| 2016/0185521 | A1 | 6/2016 | Lecocq et al. | |

FOREIGN PATENT DOCUMENTS

| | | | |
|---|---|---|---|
| FR | 3 009 290 | A1 | 2/2015 |
| GB | 1544631 | A | 4/1979 |
| KR | 101 032 147 | B1 | 5/2011 |
| WO | 92/14660 | A1 | 9/1992 |
| WO | 92/21572 | A1 | 12/1992 |
| WO | 2010/130961 | A1 | 11/2010 |
| WO | 2015/015085 | A2 | 2/2015 |

* cited by examiner

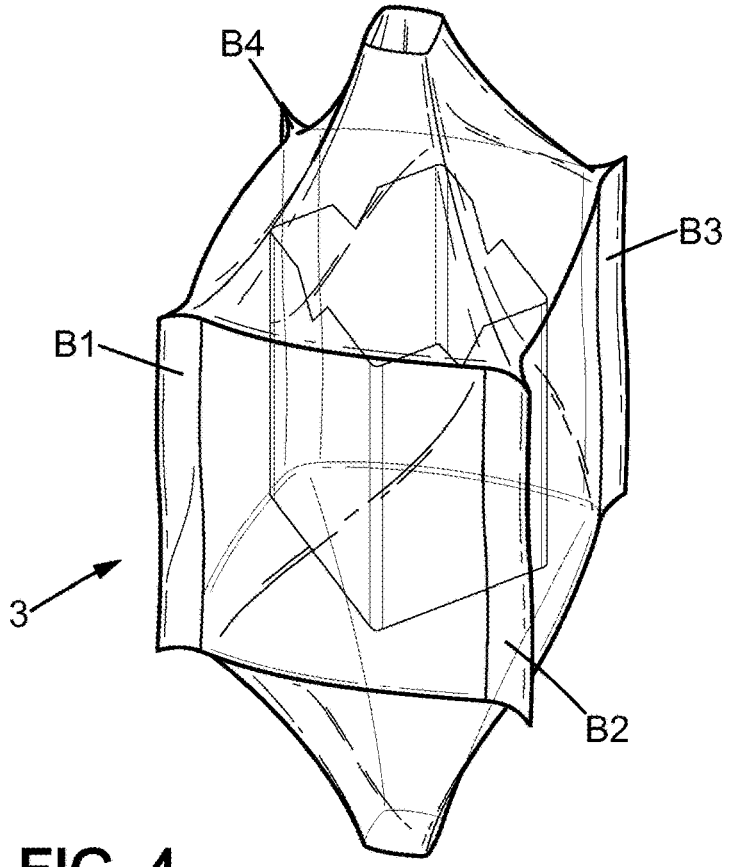
FIG. 4
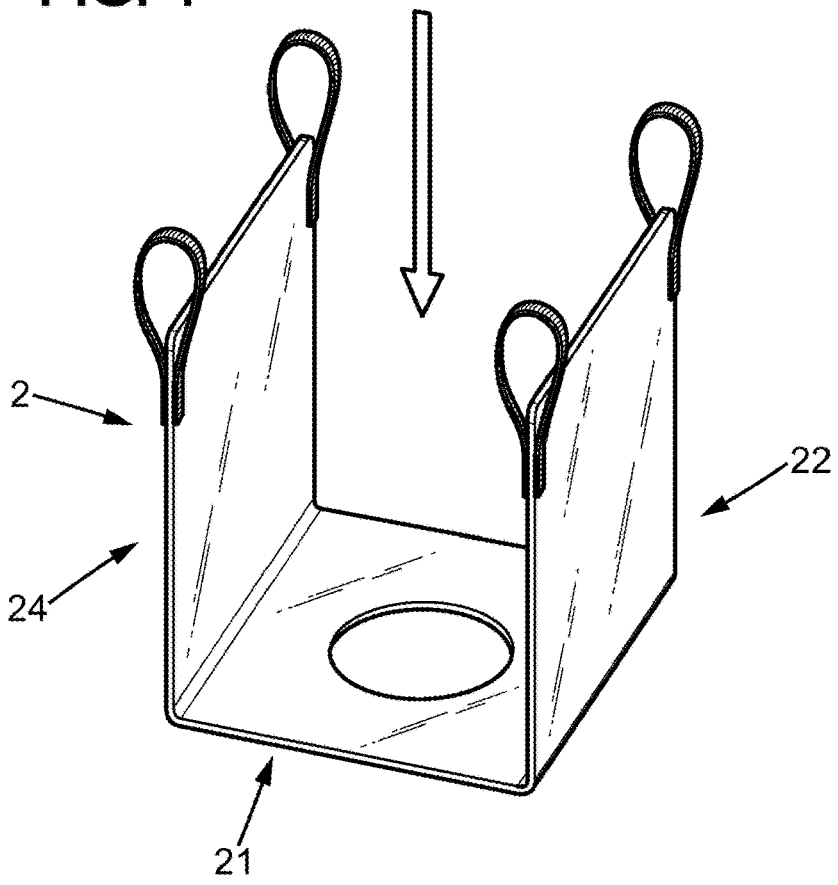

FLEXIBLE STORAGE DEVICE FOR PACKAGING PARTICULATE SOLID SUBSTANCES OR LIQUIDS, METHOD FOR MANUFACTURING THIS DEVICE AND PACKAGING METHOD USING THIS DEVICE

BACKGROUND OF THE INVENTION

The invention relates to a flexible storage device for packaging bulk solids. The field of the invention is that of large containers for packaging of large quantities of particulate solids, also called bags GRVS bags (from the French "Grand Récipient Vrac Souple") or FIBC bags (Flexible Intermediate Bulk Containers). These storage devices have been known for many years and used for protection, storage and transport of particulate bulk materials such as food materials (sugar, flour, starch), granulated polymers or chemical products.

These containers are conventionally polymer fibres fabric (for example PP, HDPE, LLDPE), optionally sealed. The capacity of these containers is generally between 0.5 and 2 $m^3$. The size and weight of large containers, once filled, makes handling difficult, in some cases even dangerous. In practice, for optimal use of storage space, the filled bags are stacked in several layers; it is thus essential to ensure stability when stacked.

According to the experience of the Applicant, in time, the particulate matter continues to settle and move in the container, thereby deforming the flexible container in a position which often deviates from the vertical, and which may lead to imbalance. These containers typically have a rectangular bottom, often square, and rectangular vertical sidewalls, which should allow, when the bags are juxtaposed, optimum filling of the available storage space. In practice, the pressure exerted on the particulate matter deforms the side walls outwardly, the filled container deviates from its ideal parallelepiped shape. The footprint of the container is thus greater than the square or rectangular base dimensions. Thus, in a lorry with a floor area of 32 $m^2$, it is not possible to juxtapose more than 24 filled containers, each with a square base of 1 m, without subjecting them to a strong tamping while loading which can cause damage.

However, the state of the art of flexible large bulk containers, especially WO 92/14660 to WO 92/21572, or WO 2010/130961A, reveals a substantially parallelepiped shape, the resistance to deformation and stability of which when filled is improved by internal, flexible, stabilizing elements.

For this purpose, flexible, vertical walls, inside the storage volume of the container, connect the side walls to one another and dividing the storage volume in a plurality of vertical compartments, namely a central compartment and four peripheral compartments.

In the containers of WO 92/14660 or that of WO 2010/130961, the edges of the partitions defining the upper mouth of the central compartment are positioned below the upper edges of the side walls of the container so as to constitute overflows during filling. The filling of such a container takes place by pouring particulate material from the top, into the central compartment, the material first filling the central compartment, and then filling the peripheral compartments by discharging into the overflow.

The pre-filling of the central compartment allows, due to the pressure of the particulate matter on the walls, to cleanly and uniformly stabilize the flexible walls of the central compartment, and before the material is poured into the peripheral compartments.

Once filled, the stability in time of the container is substantially improved compared to a conventional container (without a stabilizing element) in that it does not deviate from the vertical when placed on the floor, limiting the tipping risks of the container. Furthermore, the flexible walls connecting the side walls (to one another) limit the extent of the deformations of the side walls of the container outwardly. The size of the filled container is improved, optimizing the storage capacity.

In this prior art, the flexible partition stabilizing elements are, just as the walls of the flexible container, typically made of polymer fibre fabric (for example PP, HDPE, LLDPE), optionally made more or less air-tight by coating or lamination.

For longer storage periods, however, there is a risk of moisture uptake of the contents through the walls of the container from the external environment. According to the Applicant's findings, this moisture uptake can lead to the formation of lumps in the container, which interfere with the smooth flow of material through the bottom opening of the container once opened. In this case, and prior to the unloading of the container, it may be necessary to decake the contents of the container by mechanical operations on the external walls of the container. These decaking operations are undesirable in that they complicate unloading of materials and also constitute a damage risk to the container.

The container of WO 92/14660 discloses, however, in FIG. 9, a structure with the presence of an inner liner 28 made from a liquid impermeable material such as polyethylene, which prevents (or at least limits) moisture uptake.

The structure of the storage device of WO 92/14660 likewise comprises a container forming the bottom and four side walls of the container, typically made of fabric. Each sidewall of the container is formed by two flexible halves joined to each other by a vertical seam connecting the joint edges thereof 23. Each flexible half, furthermore has, at the upper corners of the container, a suspension loop. The device's four suspension loops can lift the filled device, conventionally by means of a lifting system.

The internal stabilizing element is constituted by a flexible tubular member, having four vertical seams, thereby forming a flexible tube the internal volume of which forms the central compartment, and four vertical strips 7 distributed at 90° around said tube, intended to be fixed respectively to the four side walls of the bag. To this end, each vertical edge of strip 7 is sandwiched between the two joint edges 23 and traversed by the same fastening seam. The inner liner 28 in FIG. 9 internally covers the side walls, above and below the container, forming a filler neck at the upper part thereof 34 and a discharge chute 35. This inner liner necessarily comprises four slots 29, each of which being traversed by the corresponding vertical strip 7 that connects the central tube of the stabilizing element to the corresponding side wall of the bag. According to the Applicant's findings, and if the flexible bulk container of WO 92/14660 not only meets the storage optimization and security issues, but also the problem of moisture uptake, it involves significant manufacturing complexity. Because of the wide slots for passage of the inner liner of polyethylene 29 the liquid-tightness of such a large container can be improved.

The known flexible intermediate bulk containers of WO 92/21572 is designed to meet the problems of optimization of storage space, security, and moisture uptake, as identified above.

To this end, the flexible intermediate bulk container of this prior art includes three subsets, namely, as shown in FIG. 5:

- A flexible container, typically made of fabric forming a rectangular bottom and four rectangular walls, provided with four suspension loops to ensure the handling of the container,
- An insert 12 forming stabilization means with the creation per se of vertical filling compartments, i.e. a central compartment, and four peripheral compartments
- An inner lining 15 interposed between the inner walls of the bag and the outer walls of the insert to make the container impermeable.

The insert is a flexible member comprising an outer envelope covering the side walls of the bag, and may be provided, as in the embodiment of FIG. 6, with an upper filling chute 29 and a lower discharge chute 30. The insert comprises a tubular member internally including a tube ("core") 34 internally forming the central vertical compartment, as well as fixing elements 25 ("strip 25"), distributed around the tube and attached to inner side walls of the outer envelope. In this prior art, the tube ("core 34") and the connecting elements 25 extend over the height of the container and divide the fill volume of the insert into the central compartment and the four peripheral compartments. The filling of such a container takes place by pouring particulate material from the top, into the central compartment, the first material filling the central compartment and the peripheral compartments through the holes 32 of increasing size over the height of the sidewall of the tube.

According to the Applicant's findings, the presence of holes 32 does not provide, as do the containers of the above-mentioned documents, the required tension for the flexible walls forming the central compartment. On the contrary, according to the findings of the Applicant, in the bulk containers on the market, the wall of the tube forming the central compartment is provided with large holes (of the order of 10 cm or more), the tension is irregular along the upper part of the tube, giving rise to folds, extending over the upper part of the tube, which are then copied to the wall of the outer envelope of the insert when the material fills the peripheral compartments. The filling of the container is thus not optimal. After filling the container, and according to the findings of the inventor, the fabric of the side walls of the container is folded along the direction of the height.

According to the embodiment of FIG. 6, the central tube ("core 34") and the fastening elements ("strips 25") are made from an integral flexible tubular element, by means of first welds 36 at the proximal end of the fastening elements 25, each defining one of the fastening elements 25 of the inner tube 34. These fastening elements 25 are then fastened in turn each by the other, distal end thereof to the inner walls of the outer envelope, by means of two other welds 37.

According to the findings of the inventor each fastening element 25 is itself a tubular element comprising two walls 33 ("bar 33") extending from the tube 34, both connected to a wall 35 ("bar 35"), forming the distal end of the element 25, this distal end being fixed by two spaced welds 37 to the outer envelope.

In summary and according to the findings of the Applicant, such a bulk bag, as disclosed in WO 92/21572, has the following disadvantages:

- The container requires three distinct sub-unit, namely, a bag, an insert, and an inner liner seal, for making the container impermeable when the bag is not itself an impermeable bag,
- The holes 32, distributed over the upper part of the wall of the central tube providing the discharge of the particulate material from the central compartment to the four peripheral compartments, cause wrinkles during filling, not only on the upper part of the tube centre of the insert, but also to the insert of the outer envelope,
- The fastening elements ("strip 25") of the embodiment of FIG. 6, are tubular, the inner space of each of these fixing elements constituting a wasted internal volume, not being used for storing the particulate material.

The purpose of the present invention is to overcome the above drawbacks by providing a flexible storage device for packaging bulk solids, with a footprint that is close to rectangular or square when filled so as to optimize storage capacity when the containers are juxtaposed, with increased security against the risk of tipping, and preferably, at least according to one embodiment, suitable for limiting the moisture uptake of the contents.

Another object of the present invention is to provide such a structural device such that it can be manufactured at a limited production cost.

SUMMARY OF THE INVENTION

Other objects and advantages of the invention appear from the following description which is given for reference only and is not intended to limit same.

The invention relates to a flexible storage device for the packaging of particulate solids having a bottom and side walls defining a substantially parallelepiped storage volume, the device comprising:

- Suspension loops in the upper part for lifting
- a unit comprising:
  - a flexible outer envelope forming at least the four side walls of the storage volume, and optionally the bottom wall of the storage volume,
  - a flexible, tubular inner envelope secured by vertical attachment lines on the four side walls of the outer envelope, dividing the storage volume into five vertical compartments, including a central compartment defined by the interior volume of the inner envelope, and four peripheral compartments, respectively defined between the side walls of the outer envelope, and the sidewalls of the inner envelope, and wherein the inner envelope has an upper edge defining the upper mouth of said central compartment and a lower edge defining the lower mouth of said central compartment, the upper edge of the inner envelope being located below or at the same height as the upper edge of the side walls of the storage volume, so that the upper edge of the inner envelope is an overflow allowing the material from the central compartment to overflow to the peripheral compartment,
  - and wherein the outer envelope is constituted by a first polymer film and the inner envelope is constituted by a second polymer film, said vertical attachment lines being the weld lines between the first polymer film and the second polymer film.

According to optional features of the invention taken alone or in combination:

- the storage means comprises a flexible container, comprising a bottom and at least two side walls, said suspension loop being secured to the upper portion of said flexible container, and wherein said unit is a separate member of said flexible container, provided as an insert between the bottom and side walls of said flexible container;
- said flexible container consists essentially of said bottom wall, and two side walls only, substantially parallel, covering two of the four side walls of the outer envelope, and so that the other two side walls of the outer envelope are not covered by the walls of said container;
- the outer envelope of the received unit as an insert into the container has no bottom, said bottom of the container being fixed to the side walls of the outer envelope, the container bottom and side walls forming the storage volume of the solid materials;
- the container material is a web of raw, coated or laminated polymer fibres;
- the outer envelope forming said bottom wall of the storage volume, both the bottom wall and the side walls of the outer envelope, forming the volume of storage for particulate solid materials;
- the bottom wall is provided with a discharge chute formed by the outer envelope, which, in the case where said device comprises said flexible container, goes through an opening in the container bottom;
- the outer envelope defines a cover provided with a filling chute;
- the suspension loops are secured directly to the corners of said unit;
- the inner envelope does not have opening(s) greater than 1 mm in diameter, preferably openings greater than 200 microns in diameter, between the upper edge of the inner envelope and the lower edge of the inner envelope;
- the upper edge of the inner envelope, has notches facing different peripheral compartments, favouring the discharge of particulate matter by overflow from the central compartment to the peripheral compartments;
- each welding line directly joins the outer envelope forming one of the side walls in the tube wall of the inner envelope defining the perimeter of the central compartment;
- the inner envelope and the outer envelope are extruded from a single polymer film that is monolayer or multilayer;
- the polymer film of the inner envelope and/or outer envelope has a thickness of between 50 and 250 microns.

According to one embodiment, the polymer film of the outer envelope and/or the inner envelope is chosen from:

- a polyamide/polyethylene complex;
- a 100% PE multi-layer;
- a polyolefin complex of the same or of different types, like EVOH;
- a complex of polyolefins and aluminium.

According to one embodiment, the outer envelope includes at four corners of the storage volume, flaps, that are substantially vertical, along the height of the storage volume, each obtained by welding together two thicknesses of the first polymer film, said vertical flaps being used as a bonding edge or seam edge or to fasten said unit to said container, or to fasten said suspension loops directly to the flaps.

According to an embodiment limiting the risk of explosion associated with the occurrence of electrostatic electrical discharges:

- the inner envelope and the outer envelope are insulating, with a surface resistivity greater than $1.0\times10^{12}\Omega$ (such as L3, devoid of a static electricity conductive layer and devoid of a static electricity dissipative layer, the envelopes 30, 40 comprising internal and external micro-perforations therethrough spread over their entire surface and so that the breakdown voltage of the entire inner envelope and outer envelope is less than 4 kV, without requiring the device to be grounded,
- the material of the container, if any, is an insulator, without antistatic additives, and without an electrically conductive layer, and the breakdown voltage of the container wall being less than 6 kV such that the storage device can be classified as type B flexible intermediate bulk containers according to standard 61340-4-4 Edition 2.0 2012-01.

Alternatively and according to another embodiment, the outer envelope and the inner envelope have a surface resistivity of between $1.0\times10^{9}\Omega$ to $1.0\times10^{12}\Omega$ (type L2) and feature dissipative agents so that the storage device can be classified as type B flexible intermediate bulk containers according to standard 61340-4-4 Edition 2.0 2012-01 when the container is made from an insulating material as defined in the standard, or type C when the container is made from a conductive material.

Alternatively and according to yet another embodiment, the outer envelope and the inner envelope are made from an electrically conductive material with a surface resistivity of less than $1.0\times10^{7}\Omega$ (type L1) so that the storage device can be classified as type C flexible intermediate bulk containers according to standard 61340-4-4 Edition 2.0 2012-01

The invention further relates to a method of manufacturing a storage device according to the invention, wherein said unit is obtained at least by the implementation of the following steps:

- a first polymer film is provided that is intended to constitute the outer envelope and a second polymer film, preferably in the form of a tubular sheath of the lower perimeter, optionally provided with discharge notches, intended to constitute the inner envelope,
- welding the second polymer film inside a tubular sheath formed by the first polymer film obtaining two coaxial flexible sheaths respectively formed by the first and the second polymer film, the two sheaths being fixed one into the other at at least four first weld lines.

According to one embodiment, vertical flaps are formed at the four corners of the storage volume of the outer envelope, each obtained by welding together two thicknesses of the first polymer film.

According to one embodiment of the method, the unit having a bottom provided with a discharge chute and/or a cover provided with a filling chute and the bottom is obtained with a discharge chute and/or said cover with a filling chute by the following successive steps:

- welding together two thicknesses of the first polymer film at four or eight corners of the sheath, each of the welds, called second welds, extending from the edge to one of the mouths of the sheath and to a longitudinal edge of the sheath, thereby obtaining the filling chute and/or the discharge chute,
- the angles of the sheath are removed by cutting the first polymer film along and on the outside of the second welds.

The invention also relates to a process for packaging the solid (or liquid) bulk materials comprising the deposit of a particulate solid material in bulk (or alternatively a liquid) from above into the central compartment of a flexible storage device according to the invention, the material (or liquid) filling said first central compartment, and then, by overflow over the upper edge of the inner envelope only, filling the four compartments.

BRIEF DESCRIPTION OF THE DRAWINGS

The invention will be better understood from reading the following description accompanied by the figures attached hereto among which:

FIG. 4 is an exploded view of the structure of a storage device according to the invention in a second embodiment, said device comprising a container, typically made of polymer fabric, provided with suspension loops, said container comprising two side walls only and a bottom, and a unit formed of first and second polymer films, defining the volume of sealed storage to particulate matter, including a cover with a filling chute and a bottom with a discharge chute, said unit being provided as an insert in the container.

DETAILED DESCRIPTION OF THE PREFERRED EMBODIMENTS

Figure 1:
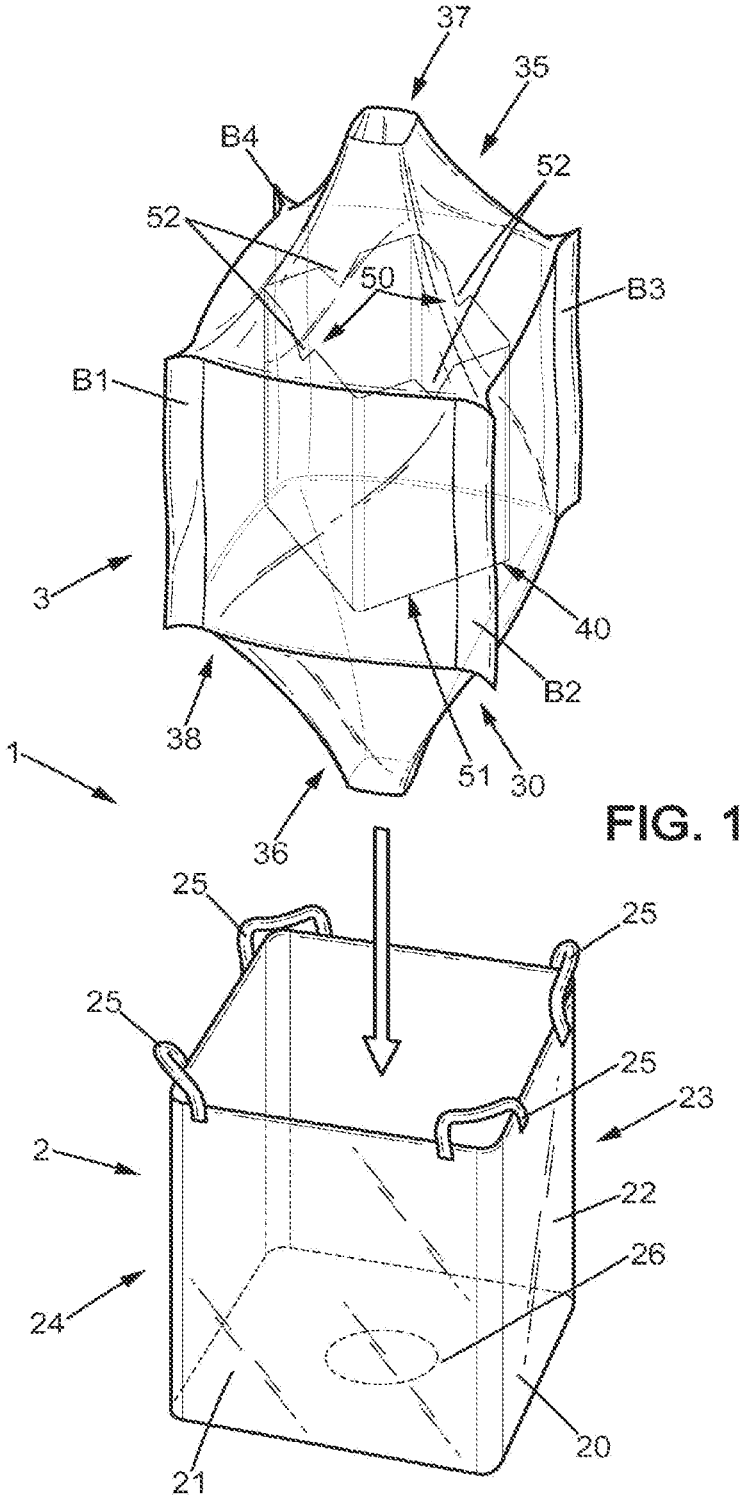
FIG. 1 is an exploded view of the structure of a storage device according to the invention in a first embodiment, said device comprising a container, typically made of polymer fabric, provided with suspension loops comprising four side walls and a bottom, and a unit formed of first and second polymer films, defining the volume of storage impermeable to particulate matter, including a cover with a filling chute and a bottom with a discharge chute, said unit being provided as an insert in the container.
Figure 1A:
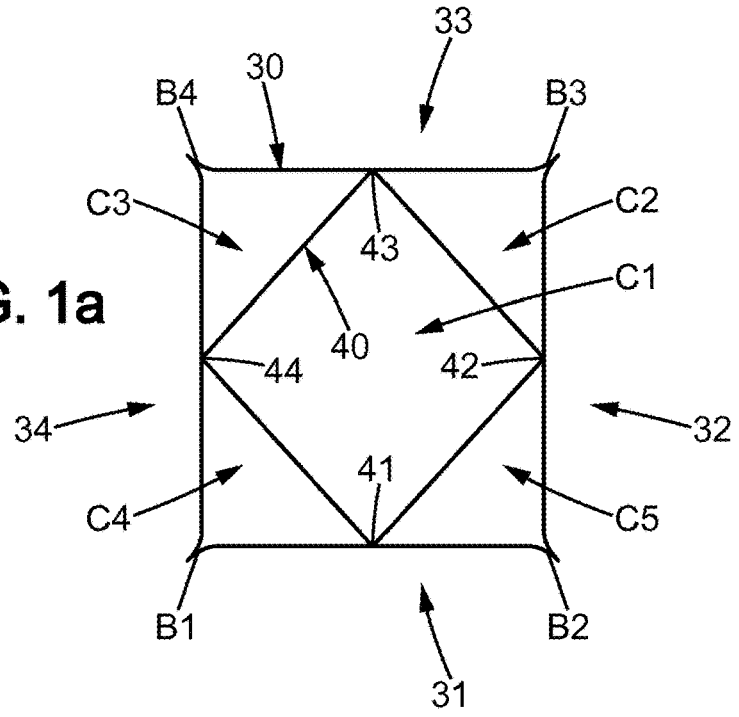
FIG. 1*a* is a horizontal section view of the unit, illustrating the central compartment and the peripheral compartments formed by the inner and outer walls of said unit, FIGS. 2*a* and 3*a*, 2*b* and 3*b*, 2*c*, 3*d* and 3*e* respectively illustrate different views of successive stages of the manufacture of a unit of a device according to the invention, in one embodiment.

The invention relates to a flexible storage device 1, 1', 1", 1''' for packaging particulate solids having a bottom and side walls defining a substantially parallelepiped storage volume. Optionally, the storage device has a cover 35, which closes the storage space from above.

Such a storage device 1, 1', 1", 1''' comprises:

the suspension loops 25 in upper part intended for lifting a unit comprising:

an outer flexible envelope 30 forming at least the four side walls 31, 32, 33, 34 of the storage volume, and optionally the bottom wall of the storage volume, an inner envelope 40, tubular, flexible, secured by vertical attachment lines 41, 42, 43, 44 of the four side walls 31, 32, 33, 34 of the outer envelope 30, dividing the storage volume in five vertical compartments C1, C2, C3, C4, C5, including a central compartment C1, defined by the interior volume of the inner envelope, and four peripheral compartments C2, C3, C4, C5, respectively defined between the side walls of the outer envelope 30 and the side walls of the inner envelope 40.

The outer envelope 30 consists essentially of a first polymer film and the inner envelope 40 consists essentially of a second polymer film, said vertical attachment lines being the weld lines between the first polymer film and the second polymer film. The first polymer film and/or the second polymer film are typically obtained by extrusion or co-extrusion when the first film and/or the second film are complex, i.e. multiple layers of the same polymer material or of several different polymers.

Weld lines, at least four in number, can be of a width between 5 mm and 20 mm. These weld lines may be optionally doubled.

As shown but not limited to the examples of the figures, each weld line can directly join the outer envelope 30 forming one of the side walls 31, 32, 33, 34 to the tube wall of the inner envelope 40 defining the perimeter of the central compartment C1.

The inner envelope 40 has an upper edge 50 defining the upper mouth of said central compartment C1 and a lower edge 51 defining the lower mouth of said central compartment C1. The upper edge 50 of the inner envelope 40 is located at the same height of the upper edge of the side walls 31, 32, 33, 34 of the storage volume, or below the upper edge of the side walls 31, 32, 33, 34 of the storage volume, so that the upper edge 50 of the inner envelope is an overflow allowing the discharge of material from the central compartment C1 to the peripheral compartment C2 to C5.

The filling of the device of the storage volume is obtained by discharge of a bulk particulate solid (or liquid) from above into the central compartment C1, the material first filling said central compartment C1, then by overflow of material over the upper edge 50 of the inner envelope 30, the four peripheral compartments C2, C3, C4, C5.

Preferably, the inner envelope 40 has no opening(s) of diameter greater than 10 mm, even none greater than 1 mm, preferably without an opening with a diameter greater than 200 microns, between the upper edge 50 of the inner envelope 40 and the lower edge 51 of the inner envelope 40. The side wall of the central compartment is C1 and impermeable to the particulate material so that the discharge of material from the central compartment C1 to the peripheral compartments C2 to C5 takes place only above the upper edge 50 forming overflows, not through holes in the wall of the central compartment as taught by the device of WO 92/21572, these holes being referenced as 9 in FIG. 5 of WO 92/21572, and 32 in FIG. 6 of WO 92/21572.

According to the findings of the inventor, the absence of such holes enables uniform stretching of the wall of the central compartment C1, and contrary to the teaching of WO 92/21572, the holes create an uneven tension in the wall of the central compartment depending on the height, with the formation of folds on the upper part during filling, which are then copied when the peripheral compartments are filled.

The inner envelope 40 may optionally be perforated, but only in order to promote de-aeration of the storage volume, and/or, and as will be described later in order to limit the breakdown voltage of unit 3: in both cases, the perforations are micro-perforations the diameter of which is determined so as to be impermeable to the particulate material.

In a first embodiment, illustrated in, though not limited by, the examples of FIGS. 1, 4, 5 and 7, said storage device may include a flexible container 2, comprising a bottom 20 and at least two side walls 21, 22, 23, 24 said suspension loops 25 being secured to the upper portion of said flexible container 2. The container 2 material is typically a web of polymer fibres, including raw, coated or laminated.

According to this first embodiment, the unit 3 is then a distinct member of said flexible container 2, scheduled for insert between the bottom and side walls of the flexible container. The side walls 31, 32, 33, 34 formed by the outer envelope 30 of the unit are respectively covered, wholly or partly, by the side walls of the flexible container 2.

According to one embodiment, illustrated in, though not limited by, FIG. 1, the container 2 may have a bottom 20, and four side walls 21, 22, 23, 24, these four side walls while coming to cover the four side walls respectively 31, 32, 33, 34 of the outer envelope 30.

Figure 5:
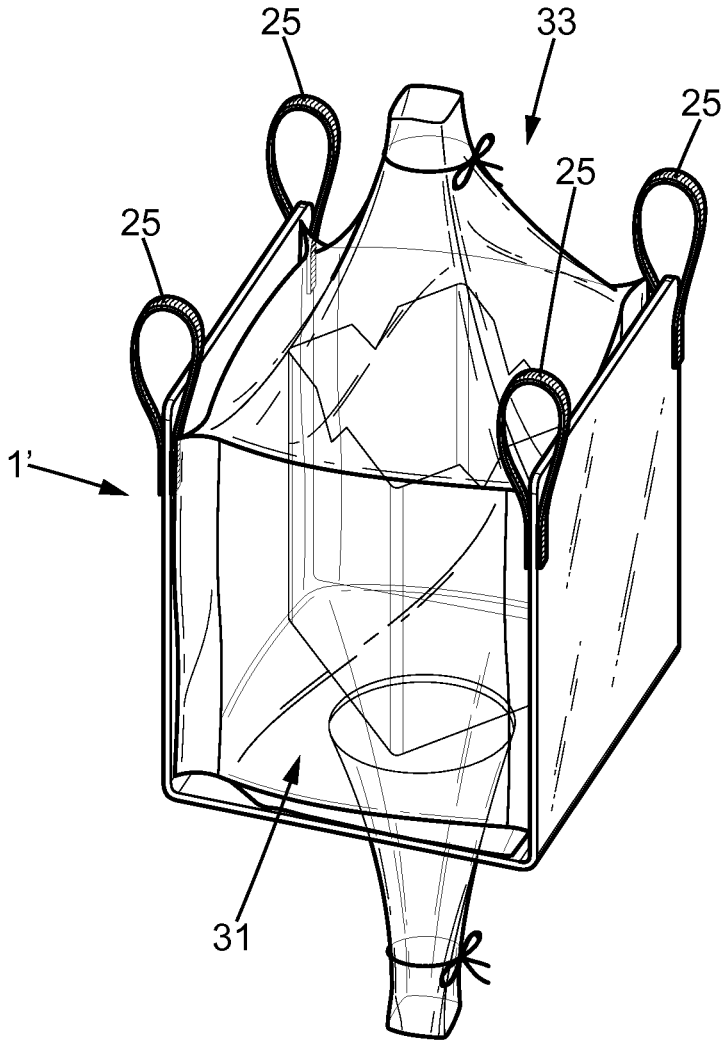
FIG. 5 is a view of the device of FIG. 4, said unit inserted in the flexible container.
Figure 7:
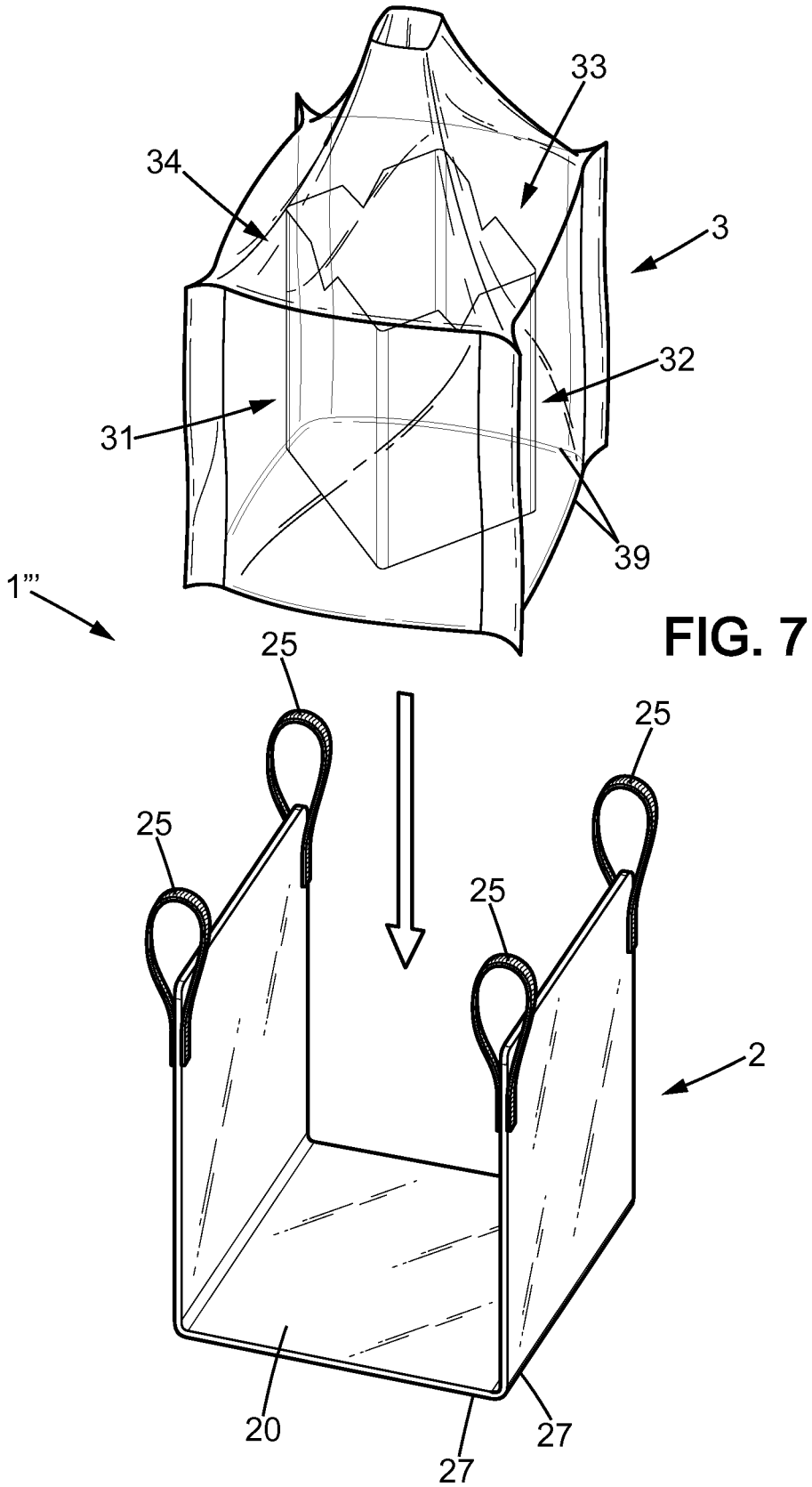
FIG. 7 is a view of a storage device according to the invention according to a fourth embodiment in which the storage volume for particulate matter is obtained by the bringing together of said unit and the container, particularly by fastening the lower edges of the side walls formed by the outer envelope to the bottom wall of the container.

According to another embodiment, illustrated in, though not limited by, FIG. 5 or FIG. 7, the container 2 may have a bottom 20 and only two side walls 22, 24 that are substantially parallel, covering two of the four side walls of the outer envelope 30. In other words, the other two side walls of the outer envelope 30 are not covered by the walls of said container 2. Such a design is advantageous in that it saves the material (polymer fabric) for the construction of the container 2. Preferably, said unit 3 is secured by stitching or bonding the two side walls 22, 24 of the container, for example, at four attachment lines extending vertically at the corners of the storage volume.

According to one embodiment, illustrated in, though not limited by, the examples of FIGS. 1, 4, 5 and 6, the outer envelope 30 also forms a bottom wall 38, said bottom 38 and the side walls 31, 32, 33, 34 of the outer envelope 30 forming the storage volume for solid materials impermeable to the particulate material.

The bottom wall 38 may be provided with a discharge chute 36, which, in the event that said device has said flexible container 2, goes through an opening 26 in the bottom 20 of container 2. The outer envelope 30 may also define a cover 35 provided with a filling chute 37. The filling chute 37 and/or the discharge chute 36 can be closed by tying. A method of manufacturing a unit comprising a bottom 38 provided with a discharge chute 36, and/or a cover 35 provided with a filling chute 37 is described hereinafter.

In the event that said outer envelope 30 forms a cover 35 and a bottom 38 forming the side walls 31, 32, 33, 34, a storage volume that is impermeable to the particulate material, the storage device may advantageously be devoid of said container 2, typically made of fabric. The suspension loops 25 are then secured directly, rigidly connected to said unit 3, typically at the four corners of the storage volume.

Figure 6:
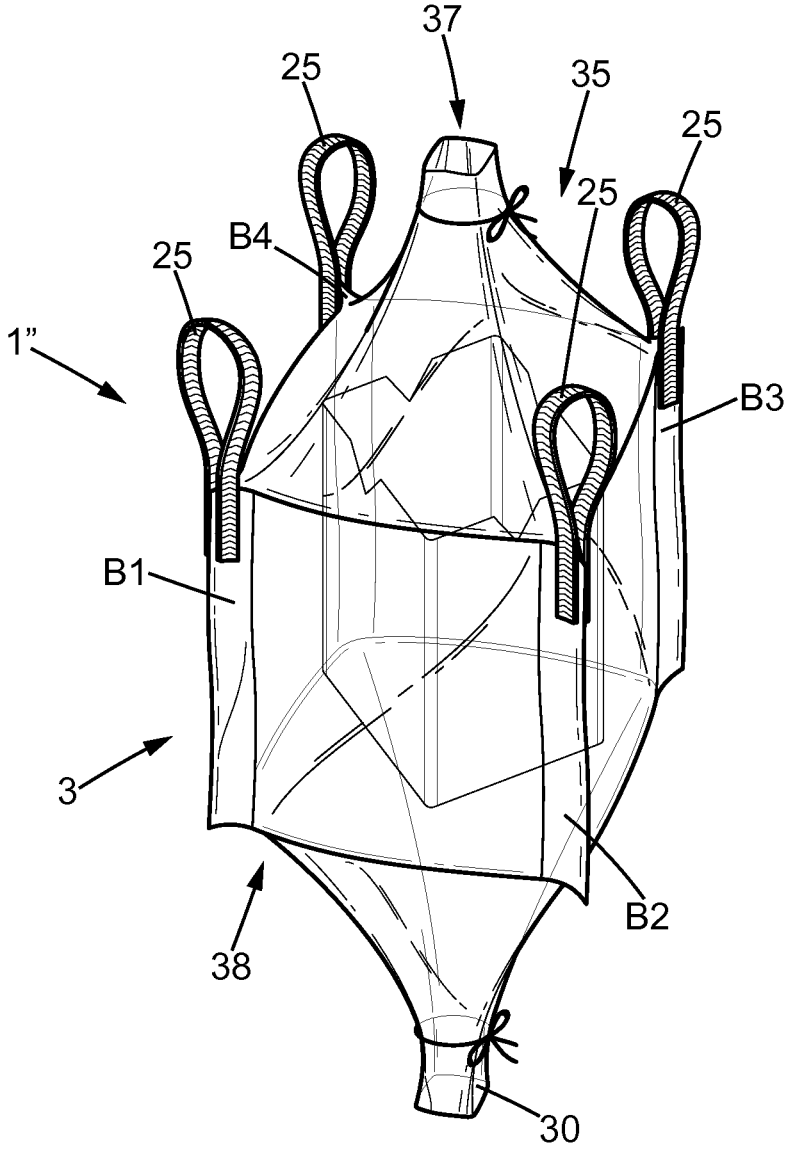
FIG. 6 is a view of a storage device according to the invention according to a third embodiment, in which the suspension loops are fixed (by sewing or by soldering) directly to said unit which forms the single storage volume for particulate matter.

Such an embodiment, illustrated in, though not limited by, FIG. 6, is specifically intended to transport moderate load, compared to the storage device with flexible container 2, typically made of fabric, which will raise more substantial loads.

According to another embodiment, illustrated in, though not limited by, FIG. 7, the outer envelope 30 has no bottom, i.e., it is open per se at the bottom thereof, said bottom 20 of the container 2 being fixed to walls 31, 32, 33, 34 side of the outer envelope 30. According to such an embodiment, the bottom 20 of the container 2 and the side walls 31, 32, 33, 34 of the outer envelope 30 form the storage volume solids that are impermeable to particulate matter, the bottom 20 of the container thus closing the bottom opening. To this end, the lower edges 39 of the side walls 31, 32, 33, 34 of the outer envelope 30 may be fixed (in a manner that is impermeable to the particulate matter) at the periphery 27 of the bottom wall 20 of the container 2. The bottom is then preferably made from a coated or laminated fabric to be impermeable to the particulate material.

According to one embodiment, the upper edge 50 of the inner envelope 40 has notches 52, in particular in V shape, facing the various peripheral compartments C2 to C5, favouring the discharge of particulate matter by overflow from the central compartment C1 to the peripheral compartments C2 to C5.

According to one embodiment, the polymer film of the inner and/or external envelope is a wall that is between 50 microns and 250 microns thick, preferably between 90 microns and 150 microns, such as 120 microns.

The inner envelope 40 and/or the outer envelope 30 are preferably made from a single monolayer or multi-layer film, to facilitate the recycling of the unit 3.

The polymer film of the outer envelope 30 and/or the inner envelope 40 may be chosen from:

- a complex of polyamide/polyethylene
- a 100% polyethylene multi-layer,
- a polyolefins complex of the same or of different types, including such EVOH,
- a complex of polyolefins and aluminium.

According to the filling tests conducted by the Applicant, good results have been obtained with a polyamide/polyethylene complex (PA/PE), and more particularly a multi-layer (PE/binder/PA/binder/PE), i.e. comprising a polyamide layer between two polyethylene layers and two layers of binder respectively interfacing between the polyamide layer and the corresponding layers of polyethylene and a PA/PA/PE film on the same principles as before.

Such a film tested, with a thickness of 120 microns, was able to constitute a good barrier to moisture from the outside environment. Due to the low elongation under load of this polyamide/polyethylene complex, the unit showed good performance in filling, limiting the amplitude of the outward deformations of the side walls of the outer envelope, under pressure of the material and by comparison to a set of the same design wherein the first and second film are made of polyethylene only.

In general, the outer envelope 30 may have flaps B1, B2, B3, B4 that are substantially vertical, the four corners of the storage volume, on the height of the storage volume. Each of the flaps B1, B2, B3, B4 is obtained by welding together two thicknesses of the first polymer film.

These vertical flaps B1, B2, B3, B4 are used as a bonding edge or seam edge to fasten said unit 3 of said container 2 of the container, for example, as represented by the embodiment of FIG. 1 or FIG. 5.

These flaps B1, B2, B3, B4 can still be used to directly fasten said suspension loops 25, and as illustrated, by way of example and in a non-limiting fashion, in FIG. 6.

Furthermore, different construction arrangements can be used to limit explosion risks linked to the occurrence of electrostatic discharge.

According to one embodiment:

The inner envelope and the outer envelope can be insulating, having a surface resistivity greater than $1.0\times 10^{12}\Omega$, devoid of static electricity conductive layer and static electricity dissipative layer, the inner and outer envelopes 30, 40 comprising micro-perforations, preferably through-holes, spread over the entire surface thereof and so that the breakdown voltage of the entire inner envelope and outer envelope is less than 4 kV without requiring the grounding of the device, the material of the container, if needed, is an insulator, without antistatic additives, and without an electrically conductive layer, with the breakdown voltage of the container wall being less than 6 kV so that the storage device can be classified as type B flexible intermediate bulk containers according to standard 61340-4-4 Edition 2.0 2012-01.

The diameter of the micro-perforations may be between 5 microns and 130 microns, for example between 5 microns and 40 microns (μm). The diameter of microperforations is chosen according to the particle size of the material to be stored and to prevent the material from passing through the wall of the outer envelope 30 or of the inner envelope 40. The density of the microperforations on the outer 30 and inner 40 envelopes is between 0.2 perforations per $cm^2$ and 2 perforations per $cm^2$ and are preferably uniform.

Advantageously, such a storage device offers increased security against the risk of dangerous electrostatic discharge, and without requiring dissipative agents likely to migrate to the stored product and contaminate same, and without requiring the grounding of the storage device during filling or emptying operations. For more details regarding making micro-perforations, a person skilled in the art can refer to the patent application PCT/FR2014/051836 of the present applicant.

According to another embodiment, the outer envelope 30 and inner envelope 40 have surface resistivity of between $1.0\times10^9\Omega$ to $1.0\times10^{12}\Omega$ (L2 type), i.e. devoid of dissipative agents so that the storage device can be classified as type B flexible intermediate bulk containers according to standard 61340-4-4 Edition 2.0 2012-01 when the container is made from an insulating or dissipative material under of the standard, or type C when the container is made from a conductive material. Such embodiment does not require the grounding of the storage device during filling and emptying for type B, but contains dissipative agents likely to migrate the stored products.

In yet another embodiment, the outer envelope 30 and inner envelope 40 are made from an electrically conductive material having surface resistivity less than $1.0\times10^7\Omega$ (L2 type) so that the storage device can be classified as type C flexible intermediate bulk containers according to standard 61340-4-4 Edition 2.0 2012-01. Such a device, however, requires the grounding of the storage device during filling or emptying operations and safety measures against electric shock risks.

Figure 2A:
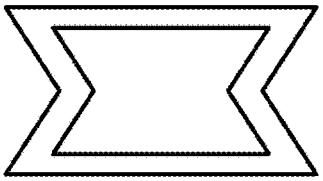
Figure 2B:
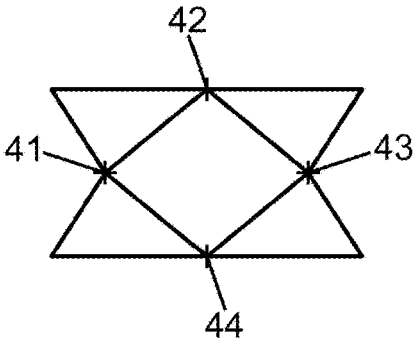
Figure 3A:
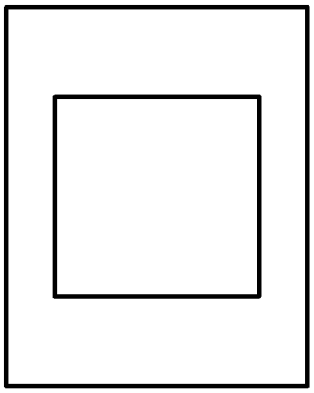
Figure 3B:
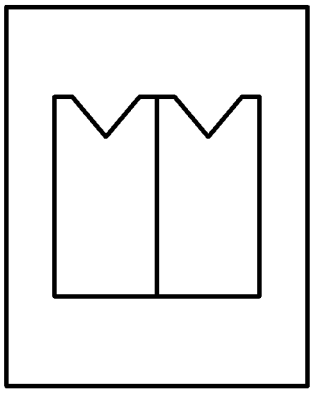
Figure 3D:
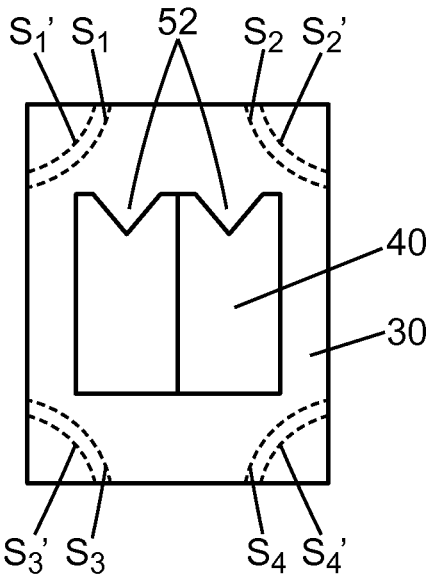

The invention further relates to a method of manufacturing a storage device according to the invention, wherein said unit 3 obtained at least by the implementation of the following steps:

a first polymer film is provided that is intended to constitute the outer envelope 30 and a second polymer film, preferably in the form of a tubular sheath of smaller diameter, optionally provided with discharge notches 52, intended to form the inner envelope 40 (see FIGS. 2*a* and 3*a*)

welding the second polymer film inside a tubular sheath formed by the first polymer film obtaining two coaxial flexible sheaths respectively formed by the first and the second polymer film, the two sheaths being fixed one into the other, at first four weld lines 41-44 (see FIGS. 2*b* and 3*d*).

These steps allow to obtain said unit, with the outer envelope 30 and inner envelope 40 which mutually define the vertical compartments (C1 to C), namely the central compartment C1, and peripheral compartments C2 to C5.

Optionally, and prior to these two steps, the first polymer film and the second polymer film can be perforated over the entire surface thereof uniformly, the preferred diameter of said microperforations being between 5 microns and 130 microns and preferably having a density of between 0.2 perforations per $cm^2$ and 2 perforations per $cm^2$, as described above.

Each of the two tubular sheaths may be obtained from the first polymer film (or second polymer film), originally in the form of a sheet, which is folded onto itself and the two edges of which are welded in order to obtain the sheath. In another alternative, the first polymer film and/or the second polymer film can advantageously be a bellows sheath extruded one piece from the outset.

Thus, according to one embodiment shown in FIG. 2*a*, the first polymer film and/or the second polymer film may each already be in the form of a bellows sheath, typically extruded in one piece.

The process may also have an additional step in which vertical flaps B1, B2, B3, B4 are formed on said unit, which will then be used as a bonding edge or seam edge as explained hereinbefore.

Figure 2C:
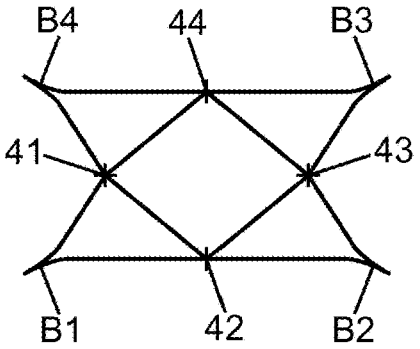

Thus, and as illustrated without limiting effect in FIG. 2*c*, vertical flaps B1, B2, B3, B4 are formed at the four corners of the storage volume of the outer envelope 30, each of the flaps being obtained by welding together two thicknesses of the first polymer film, in particular along several centimetres.

Figure 3E:
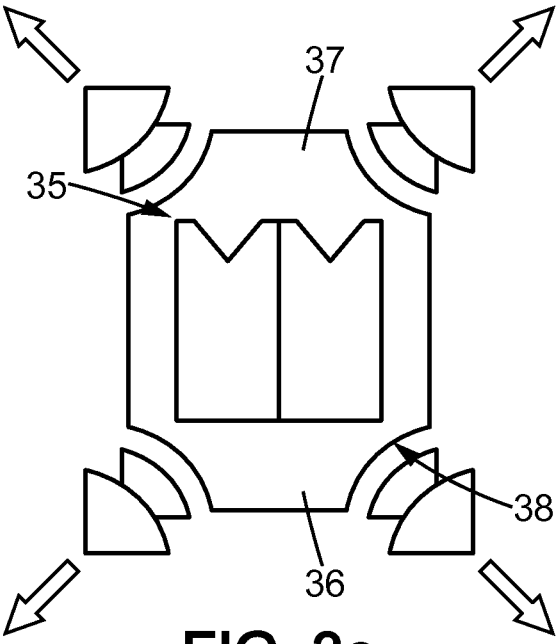

When said unit has a bottom wall 38 provided with a discharge chute 36 and/or a cover 35 provided with a filling chute 37, the bottom 38 can be obtained with discharge chute 36 and/or said cover 35 with a filling chute 37 by the following successive steps:

welding together two thicknesses of the first polymer film at four or eight corners of the sheath, each of the welds, called second welds, extending from the edge to one of the mouths of the sheath to a longitudinal edge of the sheath, thereby obtaining the filling chute and/or the discharge chute (see FIG. 3*d*), the corners of the sheath are removed by cutting the first polymer film along and on the outside of the second welds (see FIG. 3*e*).

The four upper welds (S1, S2 and S1', S2') are used to make the cover 35 with the filling chute 37 thereof, and the lower four welds (S3, S4 and S3', S4') are used to make the bottom with the discharge chute 36. Only the upper welds (S1, S2 and S1', S2') or lower welds (S3, S4 and S3', S4') or all eight can be made, as required.

Of course, other embodiments could be contemplated by a person skilled in the art without departing from the scope of the invention defined by the claims below.

NOMENCLATURE

1, 1', 1'', 1'''. Storage device,
2. Flexible container,
20. Bottom (of the container),
21, 22, 23, 24. Side walls (of the container),
25. Suspension loops,
26. Opening (Bottom 20),
27. Periphery (Bottom),
3. Set or Insert,
30. Outer envelope,
31, 32, 33, 34. Side walls,
35. Cover,

36. Discharge chute,
37. Filling chute,
38. Bottom (of the unit or insert)
39. Lower edges (of the side walls formed by the outer envelope 30),
40. Inner envelope
41 to 44. Vertical welds (first welds),
50. Upper edge,
51. Lower edge,
C1. central compartment,
C2 to C5. Peripheral compartments,
S1, S2 and S1', S2'. Upper welds,
S3, S4 and S3', S4'. Lower welds.

The invention claimed is:

1. A flexible storage device (1) for packaging of particulate solids or liquids, having a bottom and side walls defining a substantially parallelepiped storage volume with four corners at four longitudinal edges of the parallelepiped storage volume, said flexible storage device comprising:

a flexible container (2), including a bottom (20), an upper part, at least two side walls (21, 22, 23, 24), and suspension loops (25) in the upper part for lifting, said suspension loops (25) secured to the upper part of said flexible container (2), the flexible container formed of a web of raw, coated or laminated polymeric fibers; and a unit (3) configured as an insert between the bottom (20) and said at least two side walls (21, 22, 23, 24) of said flexible container, said unit (3) comprising:

a flexible outer envelope (30), comprising at least four side walls (31, 32, 33, 34) and a bottom wall, the bottom wall forming the bottom of the storage volume and the at least four side walls forming the side walls of the storage volume, said outer envelope having, at the four corners of the storage volume, substantially vertical flaps (B1, B2, B3, B4) along a height of the storage volume, said vertical flaps (B1, B2, B3, B4) being configured as a bonding edge or seam edge for securing said unit (3) to said flexible container, and a tubular, flexible inner envelope (40) secured by vertical attachment lines (41, 42, 43, 44) to the at least four side walls (31, 32, 33, 34) of the outer envelope (30), the inner envelope comprising sidewalls defined between the vertical attachment lines, and the inner envelope and the vertical attachment lines dividing the storage volume into five vertical compartments (C1, C2, C3, C4, C5), including a central compartment (C1) defined by an interior volume of the inner envelope, and four peripheral compartments (C2, C3, C4, C5), respectively defined between the at least four side walls of the outer envelope (30) and the side walls of the inner envelope (40), wherein the inner envelope (40) has an upper edge (50) defining an upper mouth of said central compartment (C1) and a lower edge (51) defining a lower mouth of said central compartment (C), the upper edge (50) of the inner envelope (40) being located at the same height or below an upper edge of the side walls of the storage volume, so that the upper edge (50) of the inner envelope constitutes an overflow allowing the discharge of material from the central compartment (C1) to the four peripheral compartments (C2 to C5), said inner envelope (40) having no opening greater than 200 microns in diameter between the upper edge (50) of the inner envelope (40) and the lower edge (51) of the inner envelope (40), wherein the outer envelope (30) is constituted by a first polymer film and the inner envelope (40) is constituted by a second polymer film, the first polymer film forming a first sheath and each vertical flap of the outer envelope obtained by welding together two thicknesses of the first polymer film, and the second polymer film forming a second bellows sheath that is extruded as one piece and deprived of a weld, said vertical attachment lines being weld lines between the first polymer film and the second polymer film, each weld line directly joining the outer envelope (30), to the inner envelope (40), wherein the second polymer film and the first polymer film are between 50 microns and 250 microns thick, wherein the bottom (38) of the storage volume is provided with a discharge chute (36) formed by the outer envelope (30) that extends through an opening (26) in the bottom (20) of the flexible container (2), and wherein the outer envelope (30) defines a cover (35) provided with a filling chute (37).

2. The device according to claim 1, wherein said flexible container (2) consists essentially of said bottom (20) and only two of said at least two side walls (22, 24) that are substantially parallel, covering two of the at least four side walls of the outer envelope (30), and so that the other two of the four side walls (31, 33) of the outer envelope (30) are not covered by the walls of said container (2).

3. The device according to claim 2, wherein the second polymer film and the first polymer film are made from a same monolayer or multi-layer extruded polymer film.

4. The device according to claim 2, wherein the first polymer film and the second polymer film have surface resistivity of between $1.0\times10^{9}\Omega$ to $1.0\times10^{12}\Omega$ and are provided with dissipative agents so that the storage device is classifiable as type B flexible intermediate bulk containers according to standard 61340-4-4 Edition 2.0 2012-01 when the container is made from an insulating or dissipative material as defined in the standard, or type C when the container is made from a conductive material within the definition of the standard.

5. The device according to claim 2, wherein the first polymer film and the second polymer film are made from an electrically conductive material with surface resistivity of less than $1.0\times10^{7}\Omega$ so that the device storage is classifiable as type C flexible intermediate bulk containers according to standard 61340-4-4 Edition 2.0 2012-01.

6. The device according to claim 1, wherein the upper edge (50) of the inner envelope (40) has notches (52) facing the four peripheral compartments (C2 to C5), favoring discharge of particulate matter by overflow from the central compartment (C1) to the peripheral compartments (C2 to C5).

7. The device according to claim 6, wherein the second polymer film and the first polymer film are made from a same monolayer or multi-layer extruded polymer film.

8. The device according to claim 6, wherein the first polymer film and the second polymer film have surface resistivity of between $1.0\times10^{9}\Omega$ to $1.0\times10^{12}\Omega$ and are provided with dissipative agents so that the storage device is classifiable as type B flexible intermediate bulk containers according to standard 61340-4-4 Edition 2.0 2012-01 when the container is made from an insulating or dissipative material as defined in the standard, or type C when the container is made from a conductive material within the definition of the standard.

9. The device according to claim 6, wherein the first polymer film and the second polymer film are made from an electrically conductive material with surface resistivity of less than $1.0\times10^{7}\Omega$ so that the device storage is classifiable as type C flexible intermediate bulk containers according to standard 61340-4-4 Edition 2.0 2012-01.

10. The device according to claim 1, wherein the second polymer film and the first polymer film are made from a same monolayer or multi-layer extruded polymer film.

11. The device according to claim 1, wherein at least one of the first polymer film and the second polymer film is one selected from the group consisting of:

a complex of polyamide/polyethylene a 100% PE multi-layer, a polyolefins complex of the same or of different types, and a complex of polyolefins and aluminium.

12. The device according to claim 1, wherein the outer envelope (30) and the inner envelope (40) have surface resistivity of between $1.0\times10^{9}\Omega$ to $1.0\times10^{12}\Omega$ and are provided with dissipative agents so that the storage device is classifiable as type B flexible intermediate bulk containers according to standard 61340-4-4 Edition 2.0 2012-01 when the container is made from an insulating or dissipative material as defined in the standard, or type C when the container is made from a conductive material within the definition of the standard.

13. The device according to claim 1, wherein the first polymer film and the second polymer film are made from an electrically conductive material with surface resistivity of less than $1.0\times10^{7}\Omega$ so that the storage device is classifiable as type C flexible intermediate bulk containers according to standard 61340-4-4 Edition 2.0 2012-01.

14. A method of manufacturing the storage device according to claim 1, wherein said unit (3) is obtained at least by implementation of the following steps:

providing the first polymer film and the second polymer film;

arranging the first polymer film to constitute the outer envelope (30);

forming the first polymer film as the first sheath having a first perimeter, four longitudinal edges, an upper edge defining an upper mouth, and a lower edge defining a lower mouth;

forming the second polymer film as the second bellows sheath having a second perimeter that is smaller than the first perimeter of the first polymer film, and arranging said second polymer film to constitute the inner envelope (40);

welding the second bellows sheath inside the first sheath in order to obtain two flexible coaxial sheaths, respectively formed by the first and the second polymer film, the two flexible coaxial sheaths being fixed into one another at the weld lines (41, 42, 43, 44);

wherein the outer envelope is formed with the bottom wall (38) and the discharge chute (36) and with the cover (35) and the filling chute (37) by the following successive steps:

welding two thicknesses of the first polymer film together at eight locations to form eight vertices by welds (S1, S2, S1', S2', S3, S4, S3', S4') that each extend from one of either the upper edge or the lower edge of the first sheath to a respective one of four longitudinal edges of the first sheath to form eight angles, and removing the eight angles of the first sheath by cutting the first polymer film along and on an outside of the welds (S1, S2, S1', S2', S3, S4, S3', S4').

15. The method according to claim 14, wherein the second polymer film is provided with discharge notches.

16. A method for packaging bulk solid materials comprising the pouring of a bulk particulate solid material, or a liquid material, from above into the central compartment (C1) of the flexible storage device according to claim 1, the first material filling said central compartment, and then by overflow of the material above the upper edge (50) of only the inner envelope (40), the four peripheral compartments (C2, C3, C4, C5).

* * * * *